United States Patent [19]

Senshu et al.

[11] 4,407,924

[45] Oct. 4, 1983

[54] TONER COMPLEXES FOR DEVELOPING ELECTROSTATIC IMAGES

[75] Inventors: Hisashi Senshu, Neyagawa; Kazuhiro Ishikawa, Nara; Yukihiko Ishida, Neyagawa; Yoji Kawagishi, Yawata, all of Japan

[73] Assignee: Orient Chemical Industries, Ltd., Japan

[21] Appl. No.: 339,491

[22] Filed: Jan. 15, 1982

[30] Foreign Application Priority Data

Jan. 23, 1981 [JP] Japan ..... 56-9249

[51] Int. Cl.[3] ..... G03G 9/08

[52] U.S. Cl. ..... 430/109; 430/110; 430/115

[58] Field of Search ..... 430/106, 110, 115, 109

[56] References Cited

U.S. PATENT DOCUMENTS 4,206,064 6/1980 Kiuchi et al. ..... 430/110

FOREIGN PATENT DOCUMENTS 56-6247 1/1981 Japan ..... 430/110

*Primary Examiner*—John E. Kittle
*Assistant Examiner*—John L. Goodrow
*Attorney, Agent, or Firm*—McGlew and Tuttle

[57] ABSTRACT

A complex system for developing electrostatic images, and particularly a toner which comprises 100 parts by weight of a resin and for instance 0.5 to 5 parts by weight of the complex system, such as a metal complex composed of, e.g. a metal such as Cr, Co or Fe, and both an aromatic dicarboxylic acid which is capable of forming an acid anhydride or of a substituted such aromatic dicarboxylic acid, and an aromatic hydroxycarboxylic acid capable of forming a complex compound or a derivative thereof, e.g. a substituted such aromatic hydroxycarboxylic acid.

28 Claims, No Drawings

TONER COMPLEXES FOR DEVELOPING ELECTROSTATIC IMAGES

FIELD AND BACKGROUND OF THE INVENTION

The present invention relates to novel toner agents in general and, in particular, to metal-containing complexes, e.g. with both an aromatic dicarboxylic acid and an aromatic hydroxy-carboxylic acid, usable in toners for developing electrostatic images in electrophotography, electrostatic recording, electrostatic printing, etc.

Conventional processes for converting latent electrostatic images to visible images are generally divided into two groups: liquid developing processes which use a developer comprising an electrically insulating liquid and a finely divided toner dispersed therein, and dry developing processes, such as the cascade process, fur brush process, magnetic brush process and powder-cloud process, in which a finely divided toner prepared by dispersing a coloring agent in a natural or synthetic resin is used singly or admixed with a solid carrier. The toners useful for such processes are charged positively or negatively in accordance with the polarity of the latent electrostatic image to be developed.

The toner can be made to retain electric changes by utilizing the triboelectric properties of the resin component of the toner, but since the toner is not highly chargeable by this method, the toner image obtained by development is prone to fogging and in turn to being obscure. To give the desired triboelectric properties to the toner, dyes and pigments for affording enhanced chargeability, and furthermore charge control agents (triboelectrification control agents), are added to the toner. Presently used in the art for this purpose are oil-soluble nigrosine dyes for positively charging toners as disclosed in Published Examined Japanese patent application No. 2427/1966, and metal-containing complex dyes for negatively charging toners as disclosed in Published Examined Japanese patent application No. 26478/1970.

However, such dyes and pigments serving as charge control agents are complex in structure and have low stability. For example, they decompose or deteriorate when subjected to mechanical friction and impact, variations in temperature and humidity conditions, electric impact, irradiation with light, etc. or they decompose at about 150° C. when kneaded with a melt. Thus, these known dyes and pigments, because of their low stability, are liable to lose their charge controlling properties. Furthermore, many of these known dyes and pigments have low compatibility with the resin component of the toner, and are therefore difficult to disperse uniformly in the toner and tend to permit uneven charging, with the result that fog occurs in the developed toner image to obscure the image. Moreover, even when the developer exhibits satisfactory developing characteristics in the initial stage of use, the dye or pigment has the drawback of becoming decomposed or of deteriorating with the increase in the number of copying cycles, ultimately rendering the toner no longer serviceable for its contemplated use.

Additionally, one of the substantial drawbacks of conventional dyes or pigments for controlling charges or imparting chargeability is that they are themselves colored materials. This is in conflict with the basic requirement that charge control agents or chargeability imparting agents which are colorless or have a pale color that can be regarded as substantially colorless must be used for toners having a specific color. Recently published Unexamined Japanese patent application No. 127726/1978 discloses a metal complex of salicylic acid or alkylsalicylic acid as a material fulfilling the aforesaid basic requirement, but it is impossible to knead fully this material with a melt of the resin component of the toner at a high temperature sufficient to dissolve or disperse the material uniformly therein since this metal complex material has an unfortunately low thermal stability.

SUMMARY OF THE INVENTION

In connection with intensive research which has been conducted on compounds usable in toners of the foregoing general type, but which have high thermal stability and good compatibility with the corresponding resin component, which can be regarded as substantially colorless and which are capable of negatively charging such toners, it has been advantageously found in accordance with the present invention that a metal complex comprising an aromatic dicarboxylic acid (aromatic moiety A) which will form, or more particularly is capable of forming, an acid anhydride and which may also have a substituent, and an aromatic hydroxycarboxylic acid (aromatic moiety B) capable of forming a complex compound or a derivative thereof, i.e. a metal-containing complex compound composed of a, e.g. chromic, cobaltic or ferric, metal atom, and both a highly aromatic compound moiety and a highly oleophilic compound moiety having alkyl or the like oleophilic substituents incorporated therein, exhibits improved properties.

More specifically, such metal containing complex compound according to the present invention not only is comparable to conventional metal-containing complex dyes in charge controlling performance, but also more importantly has good compatibility with the corresponding resin component of the toner and is thermally so stable as to be fully kneadable with a melt of such resin component. Thus, the metal-containing complex compound according to the present invention is useful as a charge control agent for providing toners having high durability and comprising chargeable particles of uniform quality, and of course does not impair the charging properties of any attendant conventional coloring agents such as metal-containing complex dyes.

Accordingly, it is among the objects and advantages of the present invention to provide metal-containing complex compounds of improved or high thermal stability, and which are usable in toners for developing electrostatic images in electrophotography, electrostatic recording, electrostatic printing, and the like, and especially toners containing such metal-containing compounds, in which the metal-containing complex compounds not only possess such markedly improved or high thermal stability but also are favorably comparable to conventional metal-containing complex dyes in charge controlling performance, and in particular are at the same time so stable thermally as to be fully kneadable with a melt of the resin component of the toner.

It is among the additional objects and advantages of the present invention to provide such improved or high thermal stability metal-containing complex compounds as useful charge control agents for attaining toners having high durability and comprising chargeable particles of uniform quality, and especially as more or less substantially colorless constituents, which are fully compatible with the corresponding resin component of the toners as well as capable of negatively charging the corresponding toners, all without impairing the charging properties of conventional metal-containing complex dyes usable in association therewith.

Other and further objects and advantages of the present invention will become apparent from a study of the within specification and accompanying examples. The various features of novelty which characterize the invention are pointed out with particularity in the claims annexed to and forming a part of this disclosure. For a better understanding of the invention, its operating advantages and specific objects attained by its uses and inherent features, reference is made to the accompanying descriptive matter in which preferred embodiments of the invention are illustrated.

DESCRIPTION OF THE PREFERRED EMBODIMENTS

According to the present invention, examples of useful aromatic dicarboxylic acids (aromatic moiety A) which will form an acid anhydride, i.e. which are capable of forming the corresponding acid anhydride, and which may have a substituent or substituents, i.e. optionally substituted with one or more substituents on the aromatic nuclear moiety of such acids, are phthalic acid; alkyl($C_4$–$C_9$)phthalic acid; tetrahalogenated phthalic acid; 2,3-naphthalenedicarboxylic acid; alkyl($C_4$–$C_9$)-2,3-naphthalenedicarboxylic acid; 5,6,7,8-tetrahydro-2,3-naphthalenedicarboxylic acid; 5,6,7,8-tetrahalogenated 2,3-naphthalenedicarboxylic acid; 1,2-naphthalenedicarboxylic acid; alkyl($C_4$–$C_9$)-1,2-naphthalenedicarboxylic acid; naphthalic acid; alkyl($C_4$–$C_9$)naphthalic acid; 4,5-dihalogenated naphthalic acid; and the like, etc.; and acid anhydrides of such acids.

According to the present invention, examples of useful aromatic hydroxycarboxylic acids (aromatic moiety B) capable of forming a complex compound and derivatives thereof are salicylic acid; alkyl($C_4$–$C_9$)salicylic acid; 3,5-dialkyl($C_4$–$C_9$)salicylic acid; 2-hydroxy-3-naphthoic acid; alkyl($C_4$–$C_9$)-2-hydroxy-3-naphthoic acid; 5,6,7,8-tetrahydro-2-hydroxy-3-naphthoic acid; alkyl($C_4$–$C_9$)-5,6,7,8-tetrahydro-2-hydroxy-3-naphthoic acid; 1-hydroxy-2-naphthoic acid; alkyl($C_4$–$C_9$)-1-hydroxy-2-naphthoic acid; 5,6,7,8-tetrahydro-1-hydroxy-2-naphthoic acid; 8-hydroxy-1-naphthoic acid; and the like, etc. The metal complex compounds of the present invention can be prepared from the corresponding aromatic dicarboxylic acid component (aromatic moiety A) and aromatic hydroxy carboxylic acid component (aromatic moiety B) by the following process.

The corresponding aromatic dicarboxylic acid contemplated is dispersed in a compatible vehicle such as water or dissolved in compatible solvent such as methanol, ethanol, ethyl cellosolve or the like, and a metal imparting agent is added to the dispersion or solution in a mole ratio of substantially about one mole of the agent, i.e. one gram atom of the metal, per mole of the acid (aromatic moiety A). The mixture is then heated, a pH adjusting agent is then added to the mixture for the adjustment of the pH thereof, and the reaction mixture is reacted to obtain a 1:1 type metal complex compound. Subsequently, the corresponding aromatic hydroxycarboxylic acid contemplated is admixed with the resulting interim reaction mixture in a mole ratio of one mole of the latter acid (aromatic moiety B) per mole of the interim reaction mixture complex compound for further reaction thereof, e.g. in the presence of water or an aqueous reaction medium. The resulting final (equimolar) reaction mixture, when containing a precipitate, is adjusted to the desired pH, e.g. in conventional manner, and then filtered to separate the desired product. When the resulting final (equimolar) reaction mixture is a solution, the mixture is diluted with water containing a mineral acid, e.g. hydrochloric acid, to form a precipitate, which is filtered off.

It is believed that, according to the present invention, the product thus obtained will be represented by the formula

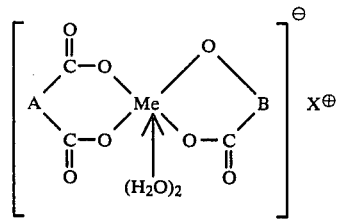

(I)

wherein A is an aromatic moiety which corresponds to the dicarboxylic acid contemplated, and which may contain one or more substituents thereon, B is an aromatic moiety which corresponds to the hydroxycarboxylic acid contemplated, and which may contain one or more substituents thereon, Me is Cr, Co or Fe, and X is a counter ion.

The particular counter ion or cation in this regard can be changed according to the conditions of the after-treatment of the product. For example, when the reaction mixture or precipitate before filtration is adjusted to a pH of up to 4 such as by treatment with a dilute mineral acid such as hydrochloric acid, and the product which is then filtered off is washed until the pH thereof becomes about 6 to 7, the counter ion is the hydrogen ion. If the product is adjusted to a pH of about 9 to 10 with an alkali, such as an inorganic base, e.g. an aqueous solution of an alkali metal hydroxide such as caustic soda, the counter ion is the corresponding basic cation, e.g. the alkali metal ion such as the sodium ion.

Furthermore, when the product is treated with hydrochloric acid salts of amines, various corresponding ammonium salts are obtained.

Cr compounds, Co compounds and Fe compounds are usable as metal imparting agents according to the present invention. While complexes of such metal compounds are similar in charge controlling ability, according to the present invention, Fe complexes are slightly colored unlike the other complexes.

It will be appreciated that whereas various dicarboxylic acids are usable for producing the instant metal complex compounds in view of the compatibility of the resultant product with the toner resin, such acids can be used in admixture, i.e. mixtures of different aromatic dicarboxylic acids and/or mixtures of different aromatic hydroxycarboxylic acids may be concordantly reacted with the particular metal imparting agent, in which case a mixture of symmetric and asymmetric aromatic moiety containing complexes having complicated, e.g. complex or varied, desirable properties can be obtained.

The toners contemplated by the present invention comprise the instant metal-containing complex compound, a known resin for toners and a coloring agent. According to the present invention, these toners are prepared by admixing the instant metal-containing complex compound and a coloring agent with a known resin for toners, preferably including a step of kneading the components while the resin is in molten condition at elevated temperature.

Examples of useful resins in this regard are polystyrene, poly-P-chlorostyrene, polyvinyltoluene and like homopolymers of styrene and substituted styrene, styrene-P-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl chloromethacrylate copolymer, styrene-acrylonitrile copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-acrylonitrile-indene copolymer and like styrene copolymers, polyvinyl chloride, polyvinyl acetate, polyethylene, polypropylene, silicone resin, polyester, polyurethane, polymide, epoxy resin, polyvinyl butyral, rosin, modified rosin, terpene resin, phenolic resin, xylene resin, aliphatic or alicyclic hydrocarbon resins, aromatic petroleum resins, chlorinated paraffin, paraffin wax, etc. These resins may be used singly or in admixture.

Although various known dyes and pigments are usable as coloring agents, according to the present invention, especially useful for color copy toners are Benzidine Yellow, quinacridone, copper phthalocynanine, etc.

When toners of the present invention were tested in comparison with a known toner containing BONTRON E-81 (a commercial Cr complex compound of 3,5-ditertiary butylsalicylic acid; product of Orient Chemical Industries Ltd., Japan), the toners of the present invention were advantageously found to have improved thermal stability, to be obtainable in the form of a very homogeneous mixture of the corresponding resin component of the toner and the present metal complex compound fully kneaded together in a molten state, and to possess outstanding durability, none of which was so in the case of such known toner.

Stated more specifically, the corresponding conventional toner and toners of the present invention were tested for durability by placing each specimen into a 2-liter ball mill pot, driving the pot at a speed of about 50 r.p.m and determining the amount of triboelectric charges on the specimen and the V-D chracteristics thereof with the lapse of time. Consequently, all the specimens of the present invention were found to be much more stable in the amount of triboelectric charges and V-D characteristics than the conventional specimen as well as highly resistant to mechanical agitation. This reveals or confirms that the toners of the present invention are very durable and serviceable for a prolonged period of time.

According to the present invention, therefore, toners having high durability can be prepared with use of various resins together with the instant metal-containing complex compound. Additionally, the instant metal complex, which serves as an essential component of the toners of the present invention, has an outstanding advantage in that it is colorless or substantially colorless, and therefore may be used efficiently as a charge control agent with the coloring agent also present.

For the preparation of toners, the metal complexes of the present invention, e.g. per formula (I) above, are used usually in an amount of substantially between about 0.1 to 10 parts by weight, preferably substantially between about 0.5 to 5 parts by weight, per 100 parts by weight of resin.

The resultant toner of the present invention is advantageously admixed with a carrier in the usual way to provide a developer. Any of the known carriers is usable for this purpose. Examples of useful carriers in this regard are magnetic particles, such as iron particles, glass beads, and such particles or beads coated with a resin.

The present invention will be described with reference to the following examples set forth by way of illustration and not limitation and in which the parts are all by weight otherwise specifically indicated:

EXAMPLE 1

Preparation of Cr complex of phthalic acid and 2-hydroxy-3-naphthoic acid;

A 53.2 g quantity of $CrCl_3.6H_2O$ was dissolved in 600 g of water, 33.2 g of phthalic acid was added to the solution, and the mixture was stirred with heating at 95° to 98° C. Subsequently, 63 g of diethanolamine diluted with 150 g of water was added dropwise to the mixture over a period of 60 minutes. When the interim resulting reaction mixture was spotted on filter paper, a gray liquid oozed out around a separated cake. Fifteen minutes later, 37.6 g of 2-hydroxy-3-naphthoic acid was added to the mixture, and the resulting mixture was further reacted at 95° to 98° C. When the mixture was checked in about 30 minutes by spotting in the same manner as above, a colorless liquid oozed out. The mixture was stirred for 2 hours. The final reaction mixture was adjusted to a pH of 3.2, and the corresponding precipitates was filtered off, washed with water and dried to obtain 73 g of a pale bluish green complex compound, i.e. Cr complex of phthalic acid and 2-hydroxy-3-naphthoic acid (hereinafter referred to as "Complex Compound 1").

To provide a comparison of the thermal stability of the product so obtained, such Complex Compound 1 and commercial charge control agents, namely a metal-containing complex dye "VALIFAST Black #3803" (product of Orient Chemical Industries Ltd., Japan, C.I. Acid Black #63) and said "BONTRON E-81" (Cr complex compound of 3,5-ditertiary butylsalicylic acid; product of Orient Chemical Industries Ltd, Japan) were heated on a hot plate and checked for changes. Complex Compound 1 was found to remain stable with only a slight color change (as tested at temperatures of below 350° C.). In contrast, the commercial metal-containing complex dye "VALIFAST Black #3804" ignited at about 330° C. In this latter regard, although the changes during heating were not apparent because the last mentioned dye had a black powdery appearance, such dye was found to have been decomposed when after the heating test it was dissolved in a solvent. As to BONTRON E-81, this charge control agent evolved a gas in the meantime, i.e. during the heating test, gradually changed in color and completely decomposed at about 340° C. Of course, no such ignition occurred at any said temperature during the heating test in the case of instant Complex Compound 1.

Subsequently, a toner was prepared in the following manner with use of Complex Compound 1;

| | |
|---|---|
| Styrene-butyl methacrylate copolymer ("HIMER SBM 73", product of Sanyo Kasei Co., Ltd.) (Resin component) | 100 parts |
| Carbon black ("Regal 300R", product of Cabot Corp.) (Coloring Agent component) | 10 parts |
| Complex Compound 1 (Charge Control Agent component) | 2 parts |

These ingredients were uniformly premixed by a ball mill to obtain a premix, which was then kneaded with hot rolls, cooled, thereafter coarsely ground by a continuous vibrating mill and further pulverized by a jet mill. The particles were classified to obtain a fraction comprising a powdery toner 5 to 15 microns in mean particle size. Five parts of the toner and 95 parts of iron carrier particles were mixed together to prepare a developer. The toner was found to be triboelectrically chargeable to an initial value of $-12.1$ $\mu c/g$. Even after making 50,000 electrostatic copies continuously in the usual manner, the developer was still usable without entailing any reduction in the quality of the copies.

EXAMPLE 2

Preparation of Cr complex of naphthalic acid and 2-hydroxy-3-naphthoic acid;

The procedure of Example 1 was repeated with the exception of using 43.2 g of naphthalic acid in place of phthalic acid to obtain in this case 87 g of a pale green complex compound, i.e., Cr complex of naphthalic acid and 2-hydroxy-3-naphthoic acid (hereinafter referred to as "Complex Compound 2").

A toner was prepared in the same manner as in Example 1 with the exception of using Complex Compound 2 instead of Complex Compound 1 and was similarly tested for the quality of electrostatic copies and for the amount of initial triboelectric charge. Table 1 set forth hereinbelow shows the results obtained.

EXAMPLE 3

Preparation of Cr complex of phthalic acid and 3,5-ditertiary butylsalicylic acid:

A 53.2 g quantity of $CrCl_3.6H_2O$ was dissolved in 400 g of water, 33.2 g of phthalic acid was added to the solution, and the mixture was stirred with heating at 95° to 98° C. Subsequently, 63 g of diethanolamine diluted with 150 g of water was added dropwise to the mixture over a period of 60 minutes. The mixture was further stirred for 15 minutes, and 50 g of 3,5-ditertiary butylsalicylic acid dissolved in 200 g of ethanol was added dropwise to the interim resulting reaction mixture over a period of 30 minutes. The mixture was further reacted for 2 hours under reflux. The final reaction mixture was adjusted to a pH of 3.2, and the corresponding precipitate was filtered off, washed with water and dried to obtain 85 g of a pale blue complex compound, i.e. Cr complex of phthalic acid and 3,5-ditertiary butylsalicylic acid (hereinafter referred to as "Complex Compound 3").

Complex Compound 3 was found to be thermally stable with evolution of only a small amount of gas during heating (as tested at temperatures of below 350° C. in the same manner as described in Example 1).

A toner was prepared in the same manner as in Example 1 with the exception of using Complex Compound 3 instead of Complex Compound 1 and was similarly tested for the quality of electrostatic copies and for the amount of initial triboelectric charge. Table 1 set forth hereinbelow shows the results obtained.

EXAMPLE 4

| | |
|---|---|
| Epoxy resin ("Epon 1004", product of Shell Chemical Co.) (Resin Component) | 100 parts |
| Carbon black ("Regal 300R", product of Cabot Corp.) (Coloring Agent component) | 8 parts |
| Complex Compound 1 (Charge Control Agent component) | 2 parts |

A toner was prepared from the above ingredients in the same manner as in Example 1. The amount of triboelectric charge on the toner was $-12.7$ $\mu c/g$. Even after making 50,000 electrostatic copies continuously, the toner was usable in the developer without entailing any reduction in the quality of the copies.

EXAMPLE 5

| | |
|---|---|
| Styrene resin ("Piccolastic D-125", product of Esso Petrochemical Co.) (Resin component) | 100 parts |
| Copper phthalocyanine (Coloring Agent component) | 4 parts |
| Complex Compound 2 (Charge Control Agent component) | 1 part |

A blue toner was prepared from the above ingredients in the same manner as in Example 1.

The amount of triboelectric charge on the toner was $-9.7$ $\mu c/g$. Even after making 50,000 electrostatic copies continuously, the toner in the developer was usable without entailing any reduction in the quality of the copies.

EXAMPLE 6

| | |
|---|---|
| Polyester resin (propylene glycol: maleic anhydride:phthalic anhydride = 5:2.4:2.4 in mole ratio) (Resin component) | 100 parts |
| Quinacridone (C.I. Pigment Red 122) (Color Agent component) | 4 parts |
| Complex Compound 1 (Charge Control Agent component) | 1 part |

A red toner was prepared in the same manner as in Example 1 from the above ingredients.

The amount of triboelectric charge on the toner was $-9.2$ $\mu c/g$. Even after making 50,000 copies continuously, the toner was usable without entailing any reduction in the quality of copies.

REFERENCE EXAMPLE 1 (COMPARISON)

A toner was prepared in the same manner as in Example 1 except that a known metal-containing complex dye "VALIFAST Black #3804" (product of Orient Chemical Industries Ltd., Japan, C.I. Acid Black 63) was used in place of Complex Compound 1. A developer was prepared with use of the toner and then tested similarly. Although giving copies of the same quality as in the above examples initially, the developer in the case of the known dye resulted in progressively pronounced fog thereafter and produced detrimental changes in the quality of the copies after continuously making 50,000 copies. Thus, the copies obtained with the use of the known dye toner were inferior to those of the above examples, in which the corresponding metal complex compounds according to the present invention were used in the toner.

Reference Example 2 (Comparison)

A toner was prepared in the same manner as in Example 1 but without using Complex Compound 1. A developer was prepared with the use of the resulting toner containing only the resin component and the coloring agent component, and tested similarly. The developer (i.e. in the absence of the complex compound according to the present invention) merely produced foggy copy images without any reproduction of thin lines even in the initial stage of the electrostatic copying operation.

Table 1 below shows the amounts of initial triboelectric charges on the toners obtained in each of the above examples and reference examples (comparisons) and the quality of the electrostatic copies obtained with the use of the corresponding toners thereof. The results are evaluated according to the "Good", "Fair", and "Poor" criteria as indicated in Table 1:

TABLE 1

| | Initial tribo-electric charge (μc/g) | Toner film-ing | Fog | Image density | Fixing proper-ties | Thin line reproduc-ibility | Overall copy quality* |
|---|---|---|---|---|---|---|---|
| Example 1 | −12.1 | 0 | 0 | 0 | 0 | 0 | 0 |
| Example 2 | −12.7 | 0 | 0 | 0 | 0 | 0 | 0 |
| Example 3 | −11.8 | 0 | 0 | 0 | 0 | 0 | 0 |
| Example 4 | −12.7 | 0 | 0 | 0 | 0 | 0 | 0 |
| Example 5 | −9.7 | 0 | 0 | 0 | 0 | 0 | 0 |
| Example 6 | −9.2 | 0 | 0 | 0 | 0 | 0 | 0 |
| Ref. Ex. 1 | −11.0 | Δ | Δ | 0 | 0 | Δ | Δ |
| Ref. Ex. 2 | 0.50 | X | X | X | X | X | X |

0: Good
Δ: Fair
X: Poor
*After making 50,000 copies continuously

The following further illustrative and non-limitative examples are set forth:

Examples 7(a) to (g)

The procedures of Examples 1 to 3 are repeated in analogous manner with each of the appropriate chromium, cobalt and iron metal imparting agent compounds (i.e. $CrCl_3.6H_2O$, $CoCl_2.6H_2O$, and ferric chloride hexahydrate, as the case may be, correspondingly dissolved in water), and per gram atom of the corresponding metal in such respective metal imparting agent compound, substantially one mole of each corresponding aromatic dicarboxylic acid (i.e. corresponding to aromatic moiety A) which is capable of forming its corresponding anhydride and optionally substituted with at least one nuclear substituent selected from the group consisting of alkyl having 4 to 9 carbon atoms and halo, as set forth in parts (a) to (g) below, and substantially one mole of each corresponding aromatic hydroxycarboxylic acid (i.e. corresponding to aromatic moiety B) which is capable of forming a corresponding metal complex and optionally substituted with at least one alkyl nuclear substituent having 4 to 9 carbon atoms, as set forth in items (1) to (6) below, i.e. in concordant combinations of metal imparting compound, aromatic dicarboxylic acid and aromatic hydroxycarboxylic acid, other than those combinations used to form the metal complex compounds of Examples 1 to 3, so as to provide each of the respective Cr, Co and Fe metal complex compounds of each of the following unsubstituted or nuclear substituted, as the case may be, phthalic acids and 2,3-, 1,2- and 1,8-naphthalene dicarboxylic acids, respectively, in each concordant combination with each of the following unsubstituted or nuclear substituted, as the case may be, salicylic acids and 2-hydroxy-3-, 1-hydroxy-2- and 8-hydroxy-1-naphthoic acids, respectively, all of which possess similar high thermal stability, charge controlling, substantially colorless and other properties and attributes to those of the metal complex compounds obtained in Examples 1 to 3:

Parts (i.e. acids corresponding to aromatic moiety A):

(a) phthalic acid with each compound, respectively, in each of items (1) to (6) below, (b) each halogenated phthalic acid, respectively, with each compound, respectively, in each of items (1) to (6) below, (c) each alkyl ($C_4$–$C_9$) phthalic acid, respectively, with each compound, respectively, in each of items (1) to (6) below, (d) 2,3-, 1,2- and 1,8-naphthalene dicarboxylic acid, respectively, with each compound, respectively, in each of items (1) to (6) below, (e) 5,6,7,8-tetrahydro-, 2,3-, 1,2- and 1,8-naphthalene dicarboxylic acid, respectively, with each compound, respectively, in each of items (1) to (6) below, (f) each halogenated, 2,3-, 1,2- and 1,8-naphthalene dicarboxylic acid, respectively, with each compound, respectively, in each of items (1) to (6) below, (g) each alkyl ($C_4$–$C_9$), 2,3-, 1,2- and 1,8-naphthalene dicarboxylic acid, respectively, with each compound, respectively, in each of items (1) to (6) below, Items (i.e. acids corresponding to aromatic moiety B):

(1) salicylic acid, (2) each alkyl ($C_4$–$C_9$) salicylic acid, respectively, (3) 2-hydroxy-3-, 1-hydroxy-2- and 8-hydroxy-1-naphthoic acid, respectively, (4) 5,6,7,8-tetrahydro-, 2-hydroxy-3- and 1-hydroxy-2-naphthoic acid, respectively, (5) each alkyl ($C_4$–$C_9$)-, 2-hydroxy-3-, 1-hydroxy-2- and 8-hydroxyl-1naphthoic acid, respectively, (6) each alkyl ($C_4$–$C_9$)-5,6,7,8-tetrahydro-, 2-hydroxy-3 and 1-hydroxy-2-naphthoic acid, respectively.

Thus, advantageously, the present invention broadly provides a toner for developing electrostatic images, comprising a metal complex, e.g. a metal complex selected from the group consisting of a Cr complex, a Co complex and an Fe complex, preferably a Cr complex, of an aromatic dicarboxylic acid of the type which is capable of forming its corresponding acid anhydride, and an aromatic hydroxycarboxylic acid of the type which is capable of forming a corresponding complex compound, and optionally such a metal complex which is a metal complex of a substituted aromatic dicarboxylic acid and/or of a substituted aromatic hydroxycarboxylic acid.

Preferably, the toner contains a toner resin and the metal complex is present in an amount of substantially between about 0.5 to 5 parts by weight per 100 parts by weight of the toner resin.

Advantageously, the present invention also broadly provides a charge control agent of high thermal stability, e.g. at temperatures up to but below about 350° C., i.e. thermally stable up to at least about 330° C. or 340° C., for a toner for developing electrostatic images, comprising a metal complex of a metal selected from the group consisting of Cr, Co and Fe, and preferably Cr, and substantially one molar equivalent each of an aromatic dicarboxylic acid which is capable of forming its corresponding acid anhydride, e.g. where the two carboxylic acid groups are in vicinal or side by side nuclear positions on the corresponding aromatic moiety, such aromatic moiety having from 6 to 10 nuclear carbon atoms, and of an aromatic hydroxy carboxylic acid which is capable of forming a corresponding metal complex, e.g. where the hydroxy group and carboxylic acid group are in vicinal or side by side nuclear positions on the corresponding aromatic moiety, such aromatic moiety having from 6 to 10 nuclear carbon atoms.

Optionally, the aromatic dicarboxylic acid is substituted with at least one nuclear substituent, e.g. one to four such substituents, selected from the group consisting of alkyl having 4 to 9 carbon atoms, such as straight and branched chain butyl, pentyl, hexyl, heptyl, octyl and nonyl, and halo, such as chloro, bromo, iodo and fluoro, e.g. including mixtures of such substituents. More particularly, the aromatic dicarboxylic acid may be phthalic acid, or a naphthalene dicarboxylic acid such as 1,8-naphthalene dicarboxylic acid.

Likewise, optionally, the aromatic hydroxycarboxylic acid is substituted with at least one alkyl nuclear substituent, e.g. one to four such substituents, having 4 to 9 carbon atoms, such as straight and branched chain butyl, pentyl, hexyl, heptyl, octyl and nonyl, e.g. including mixtures of such substituents. More particularly, the aromatic hydrocarboxylic acid may be a salicylic acid such as a nuclear substituted salicylic acid which is substituted with at least one, and preferably more than one, alkyl nuclear substituent having 4 to 9 carbon atoms, such as straight and branched chain butyl to nonyl as enumerated hereinabove, e.g. 3,5-alkyl ($C_4$–$C_9$), and preferably 3,5-ditertiary butyl, -2-hydroxybenzoic acid, or a hydroxy-naphthoic acid such as 2-hydroxy-3-naphthoic acid.

Preferably, either the aromatic dicarboxylic acid moiety or component or the aromatic hydroxycarboxylic acid moiety or component of the metal complex is a highly aromatic compound moiety or component such as a dinuclear or naphtho containing compound moiety or component, e.g. an unsubstituted or optionally nuclear substituted 2,3-, 1,2- or 1,8-naphthalene dicarboxylic acid, which is optionally substituted with at least one said alkyl nuclear substituent having 4 to 9 carbon atoms and/or with at least one said halo nuclear substituent, or e.g. and unsubstituted or optionally nuclear substituted 2-hydroxy-3-, 1-hydroxy-2- or 8-hydroxy-1-naphthoic acid, which is optionally substituted with at least one said alkyl nuclear substituent having 4 to 9 carbon atoms.

In turn, preferably, the other corresponding moiety or component of the metal complex is a highly oleophilic compound moiety or component such as a mononuclear or phenyl, or a dinuclear or naphtho, containing compound moiety or component which is nuclear substituted with at least one, and preferably more than one, said nuclear substituent having 4 to 9 carbon atoms, i.e. sufficient to constitute or provide such a highly oleophilic function therein, e.g. a mono to tetra alkyl ($C_4$–$C_9$) nuclear substituted, preferably tertiary butyl nuclear substituted, and optionally also mono to tri halo, and preferably chloro, nuclear substituted, 2,3-, 1,2- or 1,8-naphthalene dicarboxylic acid, or e.g. a mono to tetra alkyl ($C_4$–$C_9$) nuclear substituted, preferably tertiary butyl nuclear substituted, 2-hydroxy-3-, 1-hydroxy-2- or 8-hydroxy-1-naphthoic acid, and/or the corresponding moiety or component when the same is dinuclear or naphtho, which is in tetrahydronaphtho form, i.e. which is substituted with hydrogen.

In accordance with a particular feature of the present invention, the aromatic dicarboxylic acid is selected from the group consisting of phthalic acid and naphthalene dicarboxylic acid, and the aromatic hydrocarboxylic acid is selected from the group consisting of salicylic acid which is substituted with at least one alkyl nuclear substituent having 4 to 9 carbon atoms, e.g. di-alkyl ($C_4$–$C_9$) substituted salicylic acid, and hydroxy-naphthoic acid, and the metal of the metal complex is Cr.

Such charge control agent, in this regard, may be favorably provided in the form of a toner composition containing a toner resin and a coloring agent together therewith in finely divided intimately intermixed form. In particular, the charge control agent may be present in a charge control effective amount of substantially between about 0.1 to 10 parts by weight per 100 parts of the toner resin. Moreover, the toner composition is desirably admixed with a finely divided carrier therefor to provide a developer for developing electrostatic images.

Generally, therefore, the charge control agent may be in the form of a toner composition containing a toner resin for developing electrostatic images in admixture therewith, e.g. with the charge control agent being present in a charge control effective amount for controlling the, e.g. negative, charge of the toner resin. Of course, a coloring agent will normally also be present. Desirably, the charge control agent is present in the composition in a charge control effective amount of substantially between 1 to 10 parts, and especially substantially between about 0.5 to 5 parts, by weight per 100 parts by weight of the corresponding toner resin present.

In accordance with a specific aspect of the present invention, a charge control agent for a toner for developing electrostatic images is contemplated, comprising a metal complex of a metal selected from the group consisting of Cr, Co and Fe, i.e. trivalent chromic, cobaltic and ferric metal, and both an aromatic dicarboxylic acid which is capable of forming its corresponding acid anhydride, e.g. where the two carboxylic acid groups are in vicinal or side by side nuclear positions on the corresponding aromatic moiety, and which has from 6 to 10 nuclear atoms and is optionally substituted with at least one nuclear substituent selected from the group consisting of alkyl having 4 to 9 carbon atoms and halo, as aforesaid, and an aromatic hydroxycarboxylic acid which is capable of forming a corresponding metal complex, e.g. where the hydroxy group and the carboxylic acid group are in vicinal or side by side nuclear positions on the corresponding aromatic moiety, and which has from 6 to 10 nuclear carbon atoms and is optionally substituted with at least one alkyl nuclear substituent having 4 to 9 carbon atoms, as aforesaid.

More specifically, said metal complex is substantially thermally stable at elevated temperatures below about 350° C., e.g. thermally stable up to at least about 340° C. or up to at least about 330° C., substantially colorless as well as capable of negatively charging toner resins for developing electrostatic images, and constitutes the substantially equimolar reaction product in the presence of water, or of an aqueous reaction medium, of substantially one gram atom of said metal, in a corresponding metal imparting compound containing said metal, i.e. as metal imparting agent, with substantially one mole, or one corresponding molar equivalent per gram atom of such metal, of said aromatic dicarboxylic acid and substantially one mole, or one corresponding molar equivalent per gram atom of such metal, of said aromatic hydroxycarboxylic acid.

The resultant said reaction product will generally also contain on a corresponding equivalent basis substantially two moles or molecules of water, e.g. as coordinated solvent water, in the metal complex, as shown in formula (I) above, and the counter ion or cation of the metal complex may be selected from the group consisting of hydrogen and a basic salt cation such as an alkali cation, e.g. alkali metal cation such as sodium, or ammonium, e.g. quarternary amine derived ammonium, cation.

Preferably, the reaction product metal complex is a Cr metal complex, the aromatic dicarboxylic acid is selected from the group consisting of phthalic acid and naphthalene dicarboxylic acid, e.g. 2,3-, 1,2- and 1,8-naphthalene dicarboxylic acid, and the aromatic hydroxycarboxylic acid is selected from the group consisting of salicylic acid and which is substituted with at least one alkyl substituent, and especially two or more alkyl substituents, having 4 to 9 carbon atoms, as aforesaid, in particular di-tertiary butyl substituted salicylic acid, and hydroxy-naphthoic acid, e.g. 2-hydroxy-3-, 1-hydroxy-2- and 8-hydroxy-1- naphthoic acid.

In particular, in accordance with respective preferred features of such specific aspect of the present invention, the metal is Cr, and the aromatic dicarboxylic acid is phthalic acid and the aromatic hydroxycarboxylic acid is a hydroxynaphthoic acid, or alternatively the aromatic dicarboxylic acid is a naphthalene dicarboxylic acid and the aromatic hydroxycarboxylic acid is a hydroxy-naphthoic acid, or alternatively the aromatic dicarboxylic acid is phthalic acid and the aromatic hydroxycarboxylic acid is substituted hydroxy-naphthoic acid which is substituted with at least one alkyl substituent, and especially two or more alkyl substituents, having 4 to 9 carbon atoms, as aforesaid, in particular di-tertiary butyl.

In the same way, in accordance with such specific aspect of the present invention, the charge control agent or metal complex is provided in the form of a toner composition containing a corresponding, e.g. conventional, toner resin for developing electrostatic images in admixture therewith, preferably with a corresponding, e.g. conventional, coloring agent normally also being present therein, the charge control agent in particular being present in a charge control effective amount, e.g. of substantially between about 0.1 to 10 parts, and especially substantially between about 0.5 to 5 parts, by weight per 100 parts by weight of the toner resin, as aforesaid.

In all instances, the metal complex or complex compound or charge control agent, according to the present invention, possesses good compatibility under the circumstances with the toner resin component, is capable of negatively charging the corresponding toner without impairing the charging properties of the contemplated coloring agent component such as a metal-containing dye, and is thereby useful as a charge control agent for attaining toners having high durability and comprising particles of uniform quality. In particular, the instant metal complex or complex compound or charge control agent is not only distinguished by its substantially colorless property, but also distinguished more importantly by its improved or high thermal stability, e.g. at elevated temperatures up to but below about 350° C., i.e. thermally stable up to at least about 340° C. or up to at least about 330° C., whereby to permit its efficient mixing with a melt of the toner resin component, e.g. by kneading, all without impairing its charge control performance or the charging properties of the, e.g. conventional, coloring agent component usable in association therewith such as a metal-containing dye.

While various specific embodiments of the invention have been shown and described in detail to illustrate the application of the principles and inherent features of the invention, it will be understood that the invention may be embodied otherwise without departing from such principles and inherent features.

What is claimed is:

1. A toner for developing electrostatic images comprising a metal complex of an aromatic dicarboxylic acid, which such acid is capable of forming its corresponding acid anhydride, and an aromatic hydroxycarboxylic acid which is capable of forming a corresponding complex compound.

2. A toner according to claim 1, wherein the metal complex is a metal complex of substituted said aromatic dicarboxylic acid.

3. The toner according to claim 1, wherein the metal complex is a metal complex of a substituted said aromatic hydroxycarboxylic acid.

4. The toner according to claim 1, wherein the toner contains a toner resin and the metal complex is present in an amount of substantially between about 0.5 to 5 parts by weight per 100 parts by weight of the toner resin.

5. The toner according to claim 1, wherein the metal complex is selected from the group consisting of a Cr complex, a Co complex and an Fe complex.

6. A charge control agent for a toner for developing electrostatic images comprising a metal complex of a metal selected from the group consisting of Cr, Co and Fe, and substantially one molar equivalent each of an aromatic dicarboxylic acid which is capable of forming its corresponding acid anhydride and having from 6 to 10 nuclear carbon atoms, and of an aromatic hydroxycarboxylic acid which is capable of forming a corresponding metal complex and having from 6 to 10 nuclear carbon atoms.

7. The agent according to claim 6, wherein the aromatic dicarboxylic acid is optionally substituted with at least one substituent selected from the group consisting of alkyl having 4 to 9 carbon atoms and halo, and the aromatic hydroxycarboxylic acid is optionally substituted with at least one alkyl substituent having 4 to 9 carbon atoms.

8. The agent according to claim 7, wherein the metal is Cr.

9. The agent according to claim 6, wherein the aromatic dicarboxylic acid is phthalic acid and the aromatic hydroxycarboxylic acid is a hydroxy-naphthoic acid.

10. The agent according to claim 6, wherein the aromatic dicarboxylic acid is a naphthalene dicarboxylic acid and the aromatic hydroxycarboxylic acid is a hydroxy-naphthoic acid.

11. The agent according to claim 6, wherein the aromatic dicarboxylic acid is phthalic acid and the aromatic hydroxycarboxylic acid is substituted hydroxy-naphthoic acid which is substituted with at least one alkyl substituent having 4 to 9 carbon atoms.

12. The agent according to claim 6, wherein the aromatic dicarboxylic acid is selected from the group consisting of phthalic acid and naphthalene dicarboxylic acid, and the aromatic hydroxycarboxylic acid is selected from the group consisting of salicylic acid which is substituted with at least one alkyl substituent having 4 to 9 carbon atoms and hydroxy-naphthoic acid, and the metal is Cr.

13. A composition comprising the agent according to claim 6, in the form of a toner composition containing a toner resin and a coloring agent together therewith in finely divided intimately intermixed form.

14. The composition according to claim 13, wherein the charge control agent is present in a charge control effective amount of substantially between about 0.1 to 10 parts by weight per 100 parts of the toner resin.

15. The compositoion according to claim 13, wherein the toner composition is admixed with a finely divided carrier therefore to provide a developer for developing electrostatic images.

16. A composition comprising the agent according to claim 6 in the form of a toner composition containing a toner resin for developing electrostatic images in admixture therewith.

17. The composition according to claim 16, wherein the charge control agent is present in a charge control effective amount for controlling the charge of the toner resin.

18. The composition according to claim 17, wherein a coloring agent is also present therein.

19. The composition according to claim 16, wherein the charge control agent is present in a charge control effective amount of substantially between about 0.1 to 10 parts by weight per 100 parts of the toner resin.

20. The composition according to claim 16, wherein the charge control agent is present in a charge control effective amount of substantially between about 0.5 to 5 parts by weight per 100 parts of the toner resin.

21. A charge control agent for a toner for developing electrostatic images comprising a metal complex of a metal selected from the group consisting of Cr, Co and Fe, and both an aromatic dicarboxylic acid which is capable of forming its corresponding acid anhydride and having from 6 to 10 nuclear atoms and optionally substituted with at least one nuclear substituent selected from the group consisting of alkyl having 4 to 9 carbon atoms and halo, and an aromatic hydroxycarboxylic acid which is capable of forming a corresponding metal complex and having from 6 to 10 nuclear carbon atoms and optionally substituted with at least one alkyl nuclear substituent having 4 to 9 carbon atoms, said metal complex being substantially thermally stable at elevated temperatures below about 350° C., substantially colorless as well as capable of negatively charging toner resins for developing electrostatic images, and constituting the substantially equimolar reaction product in the presence of water of substantially one gram atom of said metal, in a corresponding compound containing said metal, with substantially one mole of said aromatic dicarboxylic acid and substantially one mole of said aromatic hydroxycarboxylic acid.

22. The agent according to claim 21, wherein the metal is Cr, and the aromatic dicarboxylic acid is phthalic acid and the aromatic hydroxycarboxylic acid is a hydroxy-naphthoic acid.

23. The agent according to claim 21, wherein the metal is Cr, and the aromatic dicarboxylic acid is a naphthalene dicarboxylic acid and the aromatic hydroxycarboxylic acid is a hydroxy-naphthoic acid.

24. The agent according to claim 21, wherein the metal is Cr, and the aromatic dicarboxylic acid is phthalic acid and the aromatic hydroxycarboxylic acid is substituted hydroxy-naphthoic acid which is substituted with at least one alkyl nuclear substituent having 4 to 9 carbon atoms.

25. The agent according to claim 21, wherein the metal is Cr, and the aromatic dicarboxylic acid is selected from the group consisting of phthalic acid and naphthalene dicarboxylic acid, and the aromatic hydroxycarboxylic acid is selected from the group consisting of salicylic acid which is substituted with at least one alkyl nuclear substituent having 4 to 9 carbon atoms and hydroxy-naphthoic acid.

26. A composition comprising the agent according to claim 21, in the form of a toner composition containing a toner resin for developing electrostatic images in admixture therewith.

27. The composition according to claim 26, wherein a coloring agent is also present therein.

28. The composition according to claim 26, wherein the charge control agent is present in a charge control effective amount of substantially between about 0.1 to 10 parts by weight per 100 parts of the toner resin.

* * * * *